United States Patent [19]

Ridge

[11] 4,344,285

[45] Aug. 17, 1982

[54] SIGNAL BLEED-DOWN VALVE

[75] Inventor: William A. Ridge, Inman, Kans.

[73] Assignee: The Cessna Aircraft Company, Wichita, Kans.

[21] Appl. No.: 118,254

[22] Filed: Feb. 4, 1980

[51] Int. Cl.[3] ..... F04B 49/08; F15B 13/04

[52] U.S. Cl. ..... 60/452; 417/218

[58] Field of Search ..... 60/452; 137/596.13; 417/218

[56] References Cited

U.S. PATENT DOCUMENTS

| | | | |
|---|---|---|---|
| 2,238,060 | 4/1941 | Kendrick | 60/452 |
| 3,186,353 | 6/1965 | Taplin | 417/218 |
| 3,401,521 | 9/1968 | Plate . | |
| 3,406,850 | 10/1968 | Hancox | 60/452 X |
| 3,742,982 | 7/1973 | Miller | 60/452 X |
| 3,989,062 | 11/1976 | Tennis | 60/452 X |
| 4,037,410 | 7/1977 | Jackson et al. . | |
| 4,037,621 | 7/1977 | Budzich | 137/596.13 |
| 4,087,968 | 5/1978 | Biancheita | 60/445 |

FOREIGN PATENT DOCUMENTS

| | | | |
|---|---|---|---|
| 1062118 | 7/1959 | Fed. Rep. of Germany | 417/218 |

*Primary Examiner*—Irwin C. Cohen

*Attorney, Agent, or Firm*—Edward L. Brown, Jr.

[57] ABSTRACT

A signal bleed-down valve in a load responsive system which is positioned in the sensing line between the pump compensator and control valve. The valve in the absence of sufficient pilot pressure opens the pump compensator to drain. Otherwise, the valve is controlled by pilot flow across a fixed orifice in the spool which creates a pressure drop acting against a spring, and moves the valve spool to a position metering the pilot flow so as to maintain a constant flow level across the valve spool regardless of the pressure level.

6 Claims, 3 Drawing Figures

SIGNAL BLEED-DOWN VALVE

DESCRIPTION OF THE PRIOR ART

A modern load responsive hydraulic system includes a variable displacement pump which is pressure and flow compensated. The pump supplies only the flow called for at a pressure level slightly more than a particular load. This type of system is typified in U.S. Pat. No. 3,401,521 which senses the load by opening the signal passage in the control valve so that the load pressure is exerted on the pump compensator, bringing the pump pressure up to a level slightly exceeding the load just prior to opening the load to the pump discharge. When the control valve is returned to neutral and the load pressure is blocked from the sensing line, there must be some way of draining the sensing line pressure, or the pump will continue to pump at that elevated pressure while the system is in neutral. The typical method of de-pressurizing a sensing line is to place a small drain orifice, also referred to as a bleed-down orifice, in the sensing line as taught in U.S. Pat. No. 4,037,410. It is desirable to have a bleed-down orifice sufficiently large so that it allows a rapid bleed-down and the pump does not standby at an elevated pressure when it is not being used. On the other hand, too large an orifice results in excessive power losses while the pump is operating at high pressure levels. Another drawback to a large bleed-down orifice is that the pump is not capable of going to its maximum pressure level due to the pressure drop in the signal line caused by the leakage. When the bleed-down orifice is sized sufficiently small to minimize the above-mentioned power loss and provide maximum pressure, it has a slow reaction time in returning to a low pressure standby which is unsatisfactory.

Another serious problem with the conventional prior art bleed-down orifice takes place in the craning mode. The craning mode is a situation wherein a crane or backhoe is holding a heavy load and it is desirous to slowly lift that load from a neutral position without the load drifting downward before it begins to lift. In systems with conventional bleed-down orifices, that initial leakage through the bleed-down orifice allows the load to momentarily drop before it begins to raise.

SUMMARY OF THE INVENTION

The present invention replaces the bleed-down orifice of the prior art systems with a valve having a spring-biased spool with a first position which dumps the pump compensator directly to drain when there is no pressure in the sensing line. This gives the system a very rapid bleed-down reaction time. The valve has a second position, when there is pressure in the sensing line, which closes the drain path from the compensator while opening up the compensator to sensing line pressure. The valve spool also allows a very slight constant drain flow from the sensing line across the spool regardless of the pressure level in the sensing line. This constant flow is caused by a variable orifice in the spool downstream from a fixed orifice which reacts in response to the pressure drop across the fixed orifice in the spool.

The present invention solves the downward drift problem in a craning mode since the pilot drain flow through the valve is approximately one-tenth that of a fixed orifice such as used in the prior art.

The principal object of the present invention is to provide a more efficient and responsive signal bleed-down function in a conventional load-responsive system.

An additional object of the present invention is to provide a bleed-down valve which has a very rapid bleed-down time once the control valve is neutrally positioned.

Another object of the present invention is to provide a bleed-down function which reduces the power loss due to leakage at operating pressures.

Another object of the present invention is to provide a bleed-down function which reduces the power required to obtain full pressure compensation under low or no-flow conditions, and thus reduces or prevents engine stall at idle speeds.

A further object of the present invention is to provide a bleed-down function which removes the need for checking devices in a control valve when in a craning mode so that the load does not noticeably drift downward before raising.

Other objects and advantages of the present invention will become more apparent to those skilled in the art from the following detailed description which proceeds with references to the accompanying drawings wherein.

Figure 1:
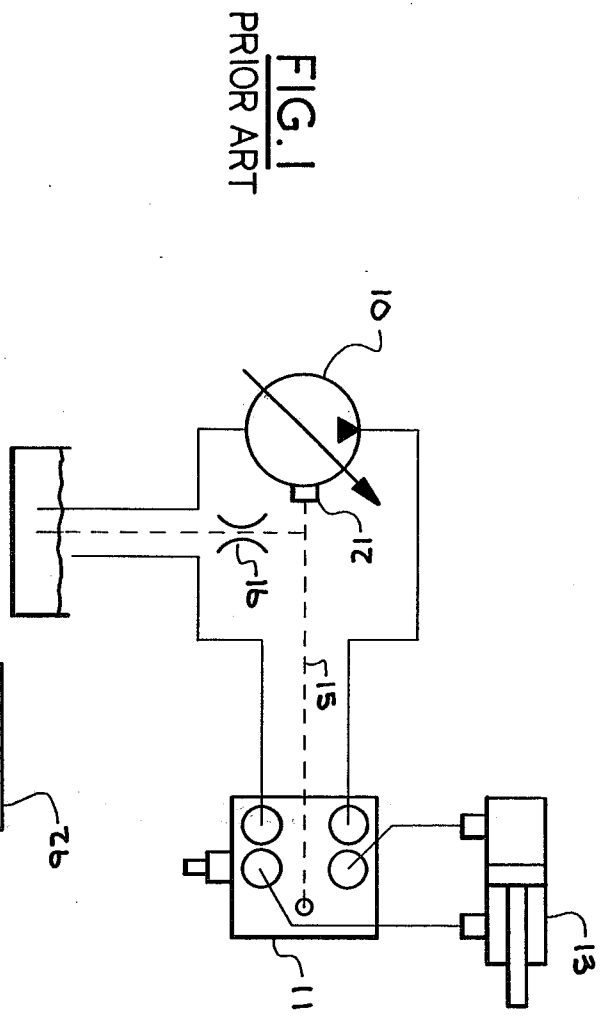
FIG. 1 PRIOR ART
FIG. 1 is a schematic view of the prior art method.

FIG. 1 symbolically illustrates a typical load responsive system of the prior art similar to the last above-mentioned patent. The system includes a variable displacement pump 10 supplying a directional control valve 11 which in turn controls a motor 13. The pump compensator 12 is pressure and flow responsive and is supplied by a signal from valve 11 through sensing line 15. When the control valve 11 is returned to its neutral position, the load pressure on motor 13 is isolated from sensing line 15. Due to the presence of bleed-down orifice 16, in the neutral position the pressure in sensing line 15 rapidly diminishes to atmospheric and the compensator accordingly strokes back the pump to a low pressure standby condition.

DETAILED DESCRIPTION OF THE PREFERRED EMBODIMENT

Figure 2:
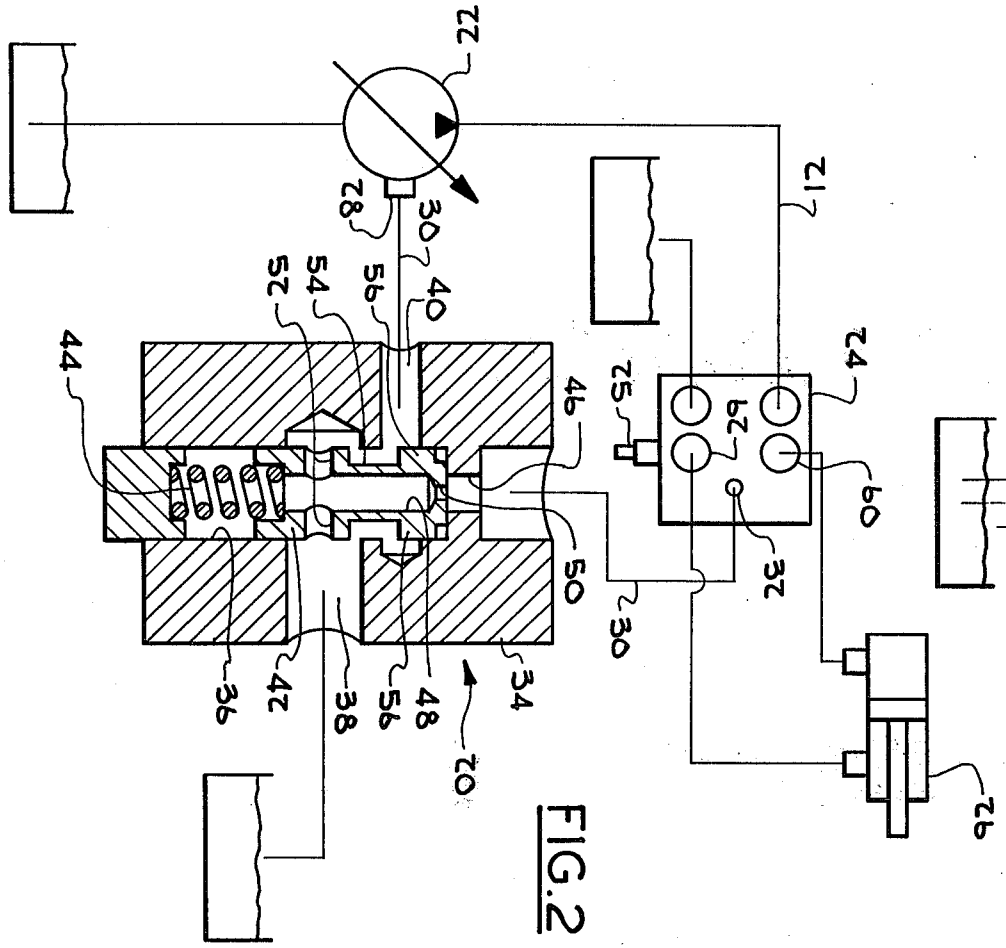
FIG. 2 is a partially schematic view of a typical load responsive system with the signal bleed-down valve of the present invention shown in its drain position.

FIG. 2 is a similar load responsive system to that shown in FIG. 1, with the substitution of the signal bleed-down valve of the present invention which is generally identified by reference numeral 20. The system includes a similar pressure flow compensated variable displacement pump 22 which supplies a conventional control valve 24 which in turn alternately supplies opposing chambers of cylinder 26. The displacement of pump 22 is controlled by a conventional pressure flow compensator 28 supplied by a pressure signal from signal port 32 through sensing line 30 and valve 20.

Figure 3:
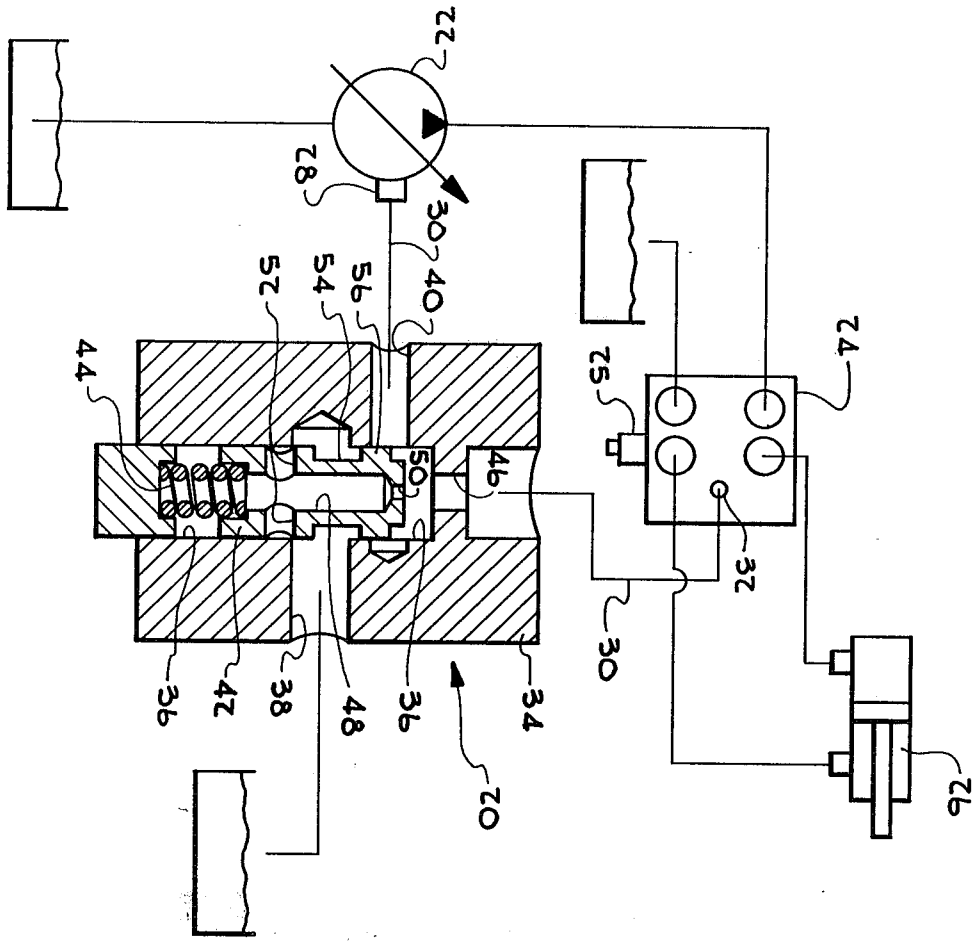
FIG. 3 is a similar view to FIG. 2 with the bleed-down valve in an operative position.

Signal bleed-down valve 20 has a body 34 which includes a bore 36 intersected by a drain cavity 38 and a compensator cavity 40. Slidably positioned in bore 36 is a valve spool 42 spring-biased against the upper end of bore 36 by compression spring 44. Valve spool 42 has a longitudinal passage 48 therethrough, terminating in a fixed orifice 50 at the upper end of the spool. Located at the lower end of spool 42 are a pair of lateral passages 52 which function as a variable orifice when the spool moves downward, as illustrated in FIG. 3. Lateral passages 52, also referred to as a variable orifice, intersect longitudinal passage 48 and are therefore located downstream from fixed orifice 50 in the flow path to drain. Fixed orifice 50 is shown in the drawings for purposes of illustration with a much exaggerated diameter, while the actual orifice diameter is approximately 0.020 inches. Valve spool 42 includes a circumferential groove 54 which dumps the pressure in compensator 28 to drain in its FIG. 2 position. Located at the upper end of spool 42 is a valve land 56 which has a dual function in valving-off the drain flow from compensator cavity 40 at the lower edge of the land while the upper edge of land 56 valves-off compensator cavity 40 to any signal pressure from control valve 24.

At the upper end of bore 36 is a reduced diameter portion 46 of the bore upon which the end of valve spool 42 seats in its drain position. Reduced diameter portion 46, along with the upper end of spool 42, functions as a servo chamber when there is a pressure drop across orifice 50, and urges valve spool 42 downwardly in opposition to spring 44.

While bleed-down valve 20 is illustrated separate and apart from the other elements of the system, it could also be incorporated either into the control valve 24 or the pump 22, if desired.

OPERATION

When the valve spool 25 of the directional control valve 24 is neutrally positioned, there is no pressure in signal port 32 and the upper sensing line 30, since any pressure will be drained to tank through orifices 50 and 52. Valve spool 42 will be in its uppermost position, as illustrated in FIG. 2, under the influence of spring 44. In this position, pump compensator 28 is drained to tank via cavity 40, spool groove 56, and cavity 38. Due to the large cross-section of this drain flow path, the bleed-down time for pump 22 is very rapid, and in fact almost instantaneous. In the FIG. 2 drain position, valve spool land 56 blocks any flow from upper sensing line 30 into pump compensator 28.

When main control valve spool 25 is moved towards one of its operative positions, valve signal port 32 is open to the load being experienced by cylinder or motor 26. This pressurizes sensing line 30 and causes flow across orifices 50 and 52 to tank, causing a pressure drop to build across orifice 50. When that pressure drop exceeds the force of spring 44, spool 42 begins to move downwardly until spool land 56 blocks drain flow from compensator cavity 40 while the upper edge of spool land 56 opens compensator cavity 40 to load pressure in upper sensing line 30, thereby causing compensator 28 to immediately pressurize and cause the pump 22 to stroke-up to a pressure level slightly exceeding that of the load. Further movement of main control spool 25 will open pump discharge line 21 to either motor port cavity 60 or 62, while the other port cavity is open to drain thereby causing cylinder 26 to move.

FIG. 3 illustrates a higher pressure operative position of signal bleed-down valve 20. As the load on motor 26 increases, it is sensed through sensing line 30 back to pump compensator 28 causing pump 22 to further stroke-out increasing its pressure level. With these increased loads, the pressure in sensing line 30 also increases as does the flow across fixed restriction 50. As flow increases across restriction 50, the pressure drop likewise increases causing spool 42 to move further downward causing variable orifice 52 to meter and close down the pilot flow to drain. Variable orifice 52 will maintain a constant pressure drop across fixed orifice 50 regardless of the load pressure in sensing line 30.

Having described the invention with sufficient clarity to enable those familiar with the art to construct and use it, I claim:

1. A load responsive system including a variable displacement pressure flow compensated pump supplying a directional control valve which in turn supplies one or more motors, the compensator of the pump is controlled by a signal through a sensing line connecting the signal port of the control valve with the compensator, the improvement comprising a signal bleed-down valve positioned in said sensing line between the compensator and the signal port comprising:

a valve body having a bore therein with the control valve sensing line connected to the upper end of the bore;

a drain cavity intersecting said bore;

valve spool means positioned in the bore; spring-biasing means urging the spool means against signal line pressure in the upper end of the bore toward a first position connecting the pump compensator to the drain cavity and blocking signal pressure to said compensator; and the spool means having a second position blocking the compensator from drain and communicating signal pressure to the compensator; and a fixed orifice in the valve spool means passing pilot flow from the signal port to said drain cavity and a variable orifice in the valve spool means downstream of the fixed orifice which maintains a constant flow across the fixed orifice regardless of signal pressure.

2. A load responsive system as set forth in claim 1, wherein the fixed orifice diameter is between 0.020 inches and 0.05 inches.

3. A load responsive system as set forth in claim 1, wherein the pilot flow passes longitudinally through the spool and the variable orifice is defined between lateral passages in the spool and the drain cavity.

4. A load responsive system of the type having a variable displacement pump compensator signaled through a sensing line from a control valve, the improvement comprising a signal bleed-down valve positioned in said sensing line between the compensator and the signal port comprising:

a valve body having a bore therein;

a drain cavity intersecting the bore;

valve spool means positioned in the bore, spring-biasing means urging the spool means towards a first position blocking signal pressure to the compensator while draining the compensator to the drain cavity and the spool means having a second position blocking the compensator from drain and communicating signal pressure to the compensator;

servo means acting on the spool means in opposition to said spring biasing means, sensing the signal pressure from the valve; and a fixed orifice in the spool means passing a pilot flow from the signal port to drain, and a variable orifice downstream of the fixed orifice which maintains a constant flow across the fixed orifice regardless of the signal pressure.

5. A load responsive system as set forth in claim 4, wherein the fixed orifice diameter is between 0.020 inches and 0.05 inches.

6. A load responsive system as set forth in claim 4, wherein the pilot flow passes longitudinally through the spool and the variable orifice is defined between lateral passages in the spool and the drain cavity.

* * * * *